United States Patent [19]

Deering

[11] Patent Number: 4,515,679

[45] Date of Patent: May 7, 1985

[54] PROCESS FOR RETORTING OIL SHALE WITH FLUIDIZED RETORTING OF SHALE FINES

[75] Inventor: Roland F. Deering, Brea, Calif.

[73] Assignee: Union Oil Company of California, Los Angeles, Calif.

[21] Appl. No.: 510,402

[22] Filed: Jul. 5, 1983

Related U.S. Application Data

[63] Continuation of Ser. No. 451,602, Dec. 20, 1982, Pat. No. 4,448,668.

[51] Int. Cl.[3] ..... C10G 1/02

[52] U.S. Cl. ..... 208/11 R

[58] Field of Search ..... 208/11 R

[56] References Cited

U.S. PATENT DOCUMENTS

| | | | |
|---|---|---|---|
| 2,783,898 | 3/1957 | Ardern et al. | 208/11 R |
| 2,966,446 | 12/1960 | Deering | 208/11 R |
| 3,004,898 | 10/1961 | Deering | 208/11 R |
| 3,361,644 | 1/1968 | Deering | 208/11 R |
| 3,501,394 | 3/1970 | Lyons | 208/11 R |
| 3,976,558 | 8/1976 | Hall | 208/11 R |
| 4,003,797 | 1/1977 | Cheadle et al. | 208/11 R |
| 4,004,982 | 1/1977 | Jennings et al. | 208/11 R |
| 4,010,092 | 3/1977 | Deering | 208/11 R |
| 4,069,132 | 1/1978 | Deering | 208/11 R |
| 4,083,770 | 4/1978 | Deering | 208/11 R |
| 4,162,960 | 7/1979 | Dhondt | 208/11 R |
| 4,263,124 | 4/1981 | Wickstrom et al. | 208/11 R |
| 4,273,617 | 6/1981 | Goedde et al. | 208/11 R |
| 4,288,294 | 9/1981 | Velling | 208/11 R |
| 4,312,740 | 1/1982 | Chiaramonte | 208/11 R |
| 4,314,899 | 2/1982 | Styring, Jr. | 208/11 R |
| 4,332,669 | 6/1982 | Spars et al. | 208/11 R |
| 4,336,126 | 6/1982 | Bertelsen | 208/11 R |
| 4,336,127 | 6/1982 | Bertelsen | 208/11 R |
| 4,340,463 | 7/1982 | Harak | 208/11 R |
| 4,366,046 | 12/1982 | Bertelsen et al. | 208/11 R |
| 4,402,823 | 9/1983 | Bertelsen | 208/11 R |
| 4,435,271 | 3/1984 | Deering et al. | 208/11 R |
| 4,446,001 | 5/1984 | Deering et al. | 208/11 R |
| 4,448,668 | 5/1984 | Deering | 208/11 R |

OTHER PUBLICATIONS

"Improvements in Oil Shale Retorts," by C. W. Mathews, *Synthetic Fuels from Oil Shale II,* Institute of Gas Technology, Mar. 1982.

"Premium Syncrude from Oil Shale Using Union Oil Technology" by Miller, Harvey and Hunter, prepared for the 1982 National Petroleum Refiners Association annual meeting held Mar. 21 to 23, 1982 at San Antonio, Tex.

"Synthetic Crude Oil and Transportation Fuels from Oil Shale" by Randle and Kelly, prepared for the 46th Midyear Meeting of the American Petroleum Institute's Refining Department, held May 11 to 14, 1981 in Chicago, Ill.

*Primary Examiner*—W. J. Shine
*Assistant Examiner*—Lance Johnson
*Attorney, Agent, or Firm*—June M. Bostich; Gregory F. Wirzbicki; Dean Sandford

[57] ABSTRACT

Hot particles removed from a retort, preferably retort-sized particles of oil shale removed from a retort operating at superatmospheric pressure, are crushed and fed to a fluidized surge zone maintained under non-oxidizing conditions at substantially the pressure of the retort to forestall escape of retort gases. Raw fines are introduced into the surge zone and retorted without agglomeration by heat transferred from the hot retorted particles and/or a heated fluidizing gas stream to educe hydrocarbonaceous vapors. Educed vapors are scrubbed, condensed and separated into liquid and gaseous product streams, a portion of the latter being recycled to provide fluidizing process gas streams.

63 Claims, 1 Drawing Figure

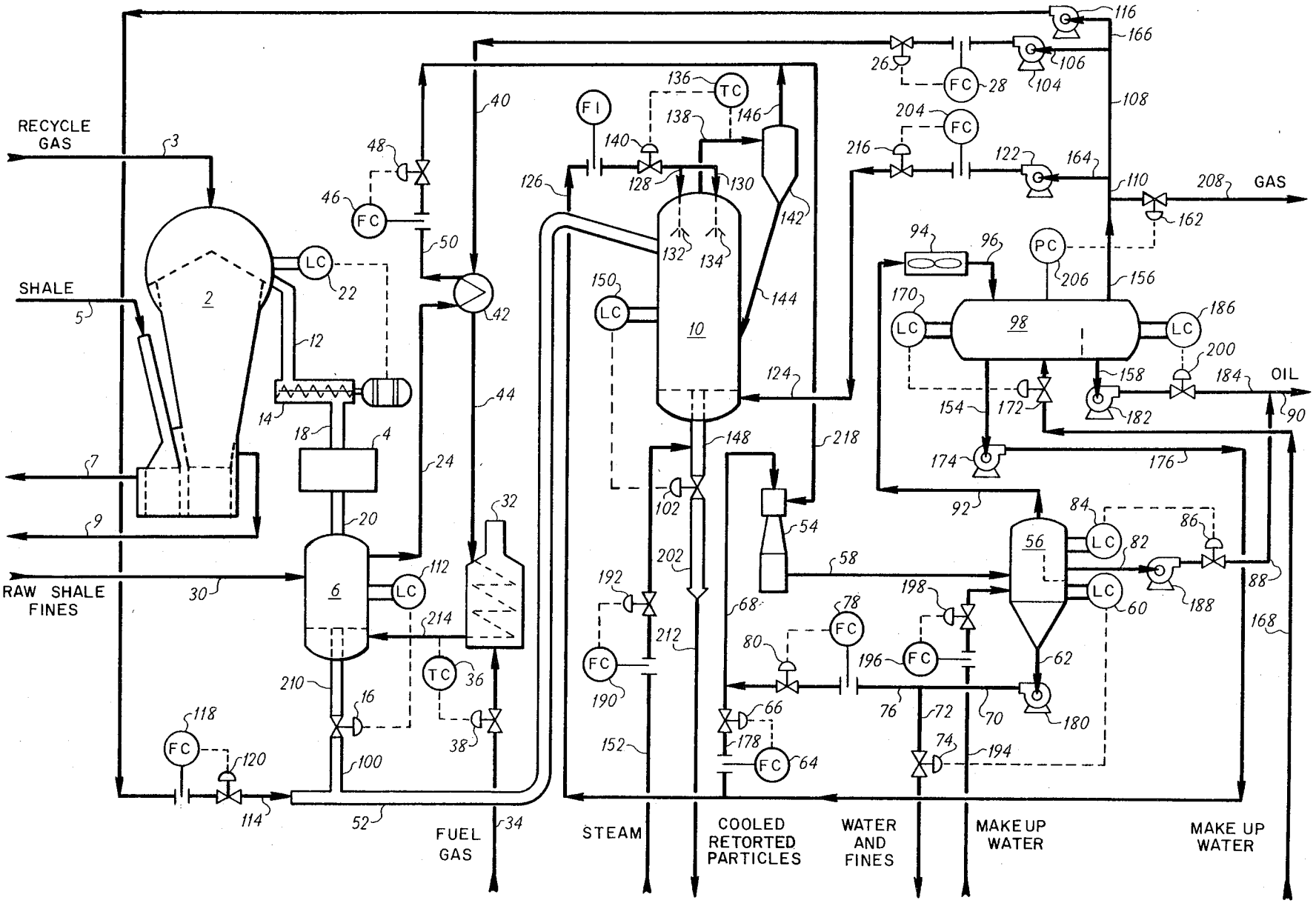
GAS
OIL
MAKE UP WATER
MAKE UP WATER
WATER AND FINES
COOLED RETORTED PARTICLES
STEAM
FUEL GAS
RECYCLE GAS
SHALE
RAW SHALE FINES

PROCESS FOR RETORTING OIL SHALE WITH FLUIDIZED RETORTING OF SHALE FINES

CROSS-REFERENCE TO RELATED APPLICATIONS

This application is a continuation in part of U.S. patent application Ser. No. 451,602, filed Dec. 20, 1982, entitled "A PROCESS FOR RETORTING OIL SHALE WITH MAXIMUM HEAT RECOVERY" now U.S. Pat. No. 4,448,668.

BACKGROUND OF THE INVENTION

This invention relates to a retorting process for recovering product hydrocarbons from oil shale and other hydrocarbon-bearing solids. The invention most particularly relates to those oil shale retorting processes within heat energy in retorted shale particles is used to recover product hydrocarbons from raw shale fines.

Many methods for recovering oil from oil shale have been proposed, nearly all of which utilize some method of pyrolytic eduction commonly known as retorting. To be competitive with the production of oils from petroleum stocks, one difficulty to be overcome is the recovery of essentially all heat value from carbonaceous material in the shale without incurring prohibitive expense or environmental damage. Since shale usually contains only about 20 to 80 gallons of oil per ton, only a limited proportion of which can be recovered as product oil or gas, economical retorting must utilize remaining heat energy contained in the shale to provide heat for pyrolytic eduction. However, sulfur emissions in flue gases released from the retorting process must be restricted to the low levels required by law while this goal is being attained.

It is known to retort oil shale by a technique of contacting up-flowing oil-bearing solids with downflowing gases in a vertical retort, and one such technique is disclosed in U.S. Pat. No. 3,361,644. To educe product vapors, the upward-moving bed of shale particles exchanges heat with a downflowing, hydrocarbonaceous and oxygen-free eduction gas of high specific heat introduced into the top of the retort at about 950° to 1200° F. In the upper portion of the retort, the hot eduction gas educes hydrogen and hydrocarbonaceous vapors from the shale and, in the lower portion, preheats the ascending bed of particles to retorting temperatures. As preheating continues, the eduction gas steadily drops in temperature, condensing high boiling hydrocarbonaceous vapors into a raw shale oil product while leaving a product gas of relatively high BTU content. The shale oil and product gas are then separated, and a portion of the product gas, after being heated, is recycled to the top of the retort as the eduction gas.

To minimize the volume of the recycle gas required, upflow retorting is usually conducted under superatmospheric pressure with the pressure in the upper regions of the retort often being between 10 and 50 p.s.i.g. However, means must be provided for introducing and recovering granular shale from the superatmospheric retorting zone without allowing valuable product and recycle gases to depressure. Conventional methods for achieving these objectives use elaborate lock vessels, valves, star feeders, or slide valves, which tend to wear rapidly and produce excessive fines through abrading the shale. Alternatively, liquid sealing devices, as in U.S. Pat. No. 4,004,982, have been employed, which operate by moving shale particles through a standing head of oil or water, thereby creating a positive back pressure to forestall escape of retort gases. Liquid seals effectively contain retort gases but leave the shale wet. When incorporated into a process for combusting retorted shale in a vessel separate from the retort, use of liquid seals would require the expense of drying the shale prior to combustion.

To increase product yield beyond what can be educed in the retort alone, processes have been developed to generate product gases by reaction of hot, retorted shale with an oxidizing gas stream, for example, as taught in U.S. Pat. No. 4,010,092. However, such gasification reactions conducted in an oxidizing environment burn the coke on retorted shale at temperatures high enough to release significant amounts of carbon dioxide from decomposing carbonates in the shale, thereby necessitating expensive removal of carbon dioxide from combustible product gases.

Another source of product yield is unretorted shale fines. Shale mined for the purpose of retorting in above-ground retorts is usually crushed mechanically to a size suitable for retorting, for example, about three inches in diameter, or smaller. Due to the friable nature of shale, fines ranging in size up to about one-half inch in diameter are generated in the mining and crushing of larger retort-sized particles in amounts up to about 10 weight percent of the total shale mined. In processes developed for use with above-ground retorts, fines mixed into the feed of larger, retort-sized particles tend to fill the void spaces between the larger particles and fuse together during retorting. As a result, circulation of hot eduction gases is channeled into the few available unfilled passageways through the voids, which consequently overheat, while circulation of heat to the rest of the retort is blocked off, leaving large underheated areas. When fines are segregated from the feed to the retort to avoid this problem, an appreciable portion of the energy available from the shale is wasted. And disposal of the segregated fines constitutes a potential hazard to the environment if noxious organic components from the shale fines seep into the environment from the disposal site.

Retorted shale contains heat value in the form of coke, and many retorting processes pass retorted shale particulates through a combustion zone to combust the coke and thus recover heat energy. However, because retorted shale generally contains sulfur components, less than complete combustion of the coke generates hydrogen sulfide, which must be removed from flue gases by means of costly sulfur recovery processes. On the other hand, complete combustion may result in flue gases containing unacceptable amounts of sulfur dioxide. To solve the problem of sulfur dioxide production during complete combustion, U.S. Pat. No. 4,069,132 discloses a combustion process wherein the sulfur dioxide generated during the combustion of coke on the retorted shale is converted to stable inorganic salts by reaction with alkaline ingredients of the shale. This process utilizes a combustor through which hot retorted shale gravitates co-currently with air for combustion diluted by sufficient flue gas to control peak combustion temperature below 1670° F. Under such conditions, the discharge of sulfur dioxide from the combustor is disclosed to be greatly minimized.

Because flue gases from combustion zones associated with shale retorts are usually at high temperature, many retorting processes recover heat therefrom. For example, as taught in U.S. Pat. No. 4,069,132, the hot flue gases may be utilized to exchange heat indirectly with boiler feedwater to generate process steam.

While the aforementioned features have met with some success, the need exists for further developments in shale retorting processes. For example, the need exists for a process by which raw shale fines can be retorted to educe and recover hydrocarbon products using heat contained in shale particles removed from an oil shale retort.

Accordingly, a principal object of this invention is to provide a process for recovering up to 100 percent of the Fischer assay of hydrocarbons from raw shale fines utilizing the heat contained in retorted shale particles removed from a shale retort to educe product vapors from the fines.

Another object of this invention is to provide a process for removing retorted shale particles from a retort while sealing the retort gases therein, crushing the particles under elevated pressure to a size suitable for fluidization, and subsequently holding the crushed particles as a fluidized bed to aid in sealing the retort while using heat energy contained in the crushed particles to effect flash pyrolysis of unretorted fines so that up to 100 percent of the Fischer assay of product hydrocarbons contained therein is recovered.

Yet another object of the invention is to retort raw shale fines using a particulate heat source held as a fluidized bed to facilitate heat exchange and prevent agglomeration of the fines.

It is another object of the invention to integrate the foregoing process and apparatus into an overall process for retorting oil shale, recovering the retorted shale without loss of retort gases, using the retorted shale to educe product hydrocarbons from unretorted shale fines under fluidized conditions and, optionally, combusting residual coke on the retorted shale under fluidized conditions for the purpose of recovering heat derived from the combustion of said coke.

SUMMARY OF THE INVENTION

A particulate heat source removed from a retort without loss of retort gases, preferably retorted shale particles removed from an oil shale retort operating at superatmospheric pressure, is crushed to a size suitable for fluidization and held in a fluidized bed at substantially retort pressure by the action of a heated, nonoxidizing fluidizing gas stream. Raw fines containing thermally decomposable carbonaceous material, preferably raw shale fines, are introduced into the fluidized bed and retorted without substantial agglomeration by heat transfer with the fluidizing gas stream and/or particulate heat source so as to educe hydrocarbonaceous vapors. The educed vapors are scrubbed to remove particulates, partially condensed, and separated into liquid and gaseous product streams, a portion of the latter preferably being recycled as the fluidizing gas stream for the process. Crushed particles are recovered from the fluidized bed while flow of gases accompanying said particles is restricted.

BRIEF DESCRIPTION OF THE DRAWING

The drawing depicts a flowsheet of the preferred embodiment of the invention wherein hot crushed shale particles recovered from an oil shale retort are used to retort raw shale fines and are subsequently cooled and sent to discharge while product hydrocarbon vapors are partially condensed and separated from particulate matter for recovery as uncondensed gases and liquid hydrocarbons.

It will be understood, however, that for the sake of simplicity, and in keeping with the usual purpose of a flowsheet, a number of conventional items such as pumps, compressors, and other equipment which themselves form no part of the invention nor aid in its description have been omitted.

DETAILED DESCRIPTION OF THE INVENTION

The preferred embodiment of the invention shown in the drawing comprises a process for educing hydrocarbon products from raw shale fines in fluidized surge vessel 6 using heat provided by hot, retorted shale particles removed from retort 2 and a heated fluidizing gas stream from conduit 214. In this invention, shale particles removed from retort 2 without substantial loss of pressure and without substantial loss of retort gases are crushed to a size suitable for fluidization at substantially retort pressure before entry into surge vessel 6. Within surge vessel 6, a fluidized bed is maintained so that high contact and heat transfer efficiencies are attained between the heated particles from standpipe 20 and the raw fines introduced through conduit 30. Conditions maintained in the fluidized bed are such that hydrocarbonaceous vapors representing between 80 and 100 percent of the Fischer assay of the raw fines are educed therefrom and recovered via conduit 24. Ultimately, after treatment in venturi scrubber 54 and scrubber separator 56, the educed vapors are separated in condensate drum 98 into condensed and uncondensed fractions. The condensed fraction is recovered as a liquid via conduit 90 while the uncondensed fraction is partially recovered via conduit 208. The remainder of the uncondensed fraction is recirculated from recycle header 110 for use in various fluidizing and carrier gas streams, such recycle being of advantage in reducing or minimizing process steam requirements.

More particularly, raw crushed oil shale is fed at 5 into a conventional upflow shale retort 2, such as that described in U.S. Pat. No. 3,361,644, which is incorporated herein by reference. Retorting is accomplished in retort 2 in a manner similar to that described in the aforementioned patent by passing raw shale upwardly through the retort. Pressure in the retort is usually between about 5 and 30 p.s.i.g., preferably about 15 p.s.i.g. Temperature of the upflowing shale is gradually increased to retorting levels, usually in excess of about 600° F., and preferably between 900° and 1200° F., by hot, countercurrently flowing eduction gases introduced via conduit 3 comprising a preheated recycle portion of retort product gas from conduit 9 (usually after removal of entrained liquid and solids in appropriate separation facilities, not shown). Educed shale oil vapors pass downwardly with the recycle gas into the lower regions of retort 2 wherein the cool oil shale condenses shale oil vapors, producing liquid shale oil which is withdrawn via conduit 7.

Retorted particles are removed from retort 2 via chute 12 at an elevated temperature, typically between about 900° and about 1000° F. and preferably between about 900° and about 950° F., and passed in series and in vertical alignment through (1) a recovery means suitable for installation above ground for removing shale particles from the retort without substantial loss of pressure and without substantial loss of retort gases, (2) a crusher to reduce the retorted shale particles to a size suitable for fluidization under substantially retorting pressure, and (3) a fluidized fines eduction and transfer system for obtaining product hydrocarbon vapors from raw shale fines and subsequently delivering the crushed particles to fluidized cooler 10 for cooling before disposal.

The drawing sets forth one combination of apparatus between retort 2 and cooler 10 to achieve the foregoing objectives, said apparatus being comprised generally of chute 12, transfer means housed within conduit 14, crusher 4, surge vessel 6, solids flow control valve 16, and gas lift 52, along with the conduits leading therebetween. In the actual practice of this invention, however, several such combinations may operate in parallel, for example, between two and ten such combinations. In the preferred embodiment, four combinations of apparatus, each one operating with the flow rates hereinafter specified for the steps of the process between retort 2 and cooler 10, transfer shale removed from retort 2 to fluidized cooler 10 while heat available from the crushed shale particles is used to raise raw shale fines in surge vessel 6 to retorting temperatures, causing the kerogen in the fines to decompose and release hydrocarbonaceous vapors. Vapors educed from the fines in each combination of apparatus are collected and subsequently condensed and separated as hereinafter described.

The shale particles gravitate from retort 2 through chute 12 into a means for transporting solids such as a vibrating feeder, or, preferably, a screw conveyor housed within conduit 14, at a rate typically between about 50 and about 250 tons per hour, preferably between about 100 and about 115 tons per hour, so that each combination of apparatus in the preferred embodiment receives about one fourth of the retorted shale flowing from retort 2. The shale particles are fed into crusher 4 through standpipe 18 at a rate controlled by response of the drive mechanism on the feeder within conduit 14 to level controller 22, which is adapted to ensure that a continuous column of shale moves through chute 12 and conduit 14.

Retorted shale particles are crushed to a size suitable for fluidization to facilitate their depressurization through gas solids flow control valves 16 and 102, which together reduce pressure on the particles from retorting pressure to atmospheric pressure preparatory to disposal. Crushing the shale particles also promotes eduction of fines in surge vessel 6 by providing for maximum heat transfer between the crushed, heated particles and raw fines under fluidized conditions. In alternative embodiments of this invention, heat is recovered from retorted shale by burning the coke contained therein in a fluidized bed combustor, a step which also requires that the retorted shale be in a crushed form. In crusher 4, therefore, the shale particles are reduced to a size usually no greater than $\frac{1}{2}$ inch, and preferably to less than $\frac{3}{8}$ inch, and usually no more than $\frac{1}{4}$ inch in mean diameter. The crusher itself may be any suitable device for reducing the size of particulate solids, preferably with a minimum of fines production, and even more preferably in a fluid-tight manner when operated at the desired pressure for crushing. Typical crushers suitable for use herein include toothed roll crushers, jaw crushers, cone crushers, and hammer crushers, with the hammer and roll varieties being preferred for their usefulness in minimizing fines production, efficiency under pressurized conditions, and high capacities relative to the size of the machines.

The crusher may operate at any desired pressure compatible with the retort pressure, but, preferably, the pressure in the crusher is substantially that of the retort. Since the preferred retorting pressure is superatmospheric, pressure in the crusher is therefore preferably also superatmospheric, usually between about 5 and 30 p.s.i.g., and preferably about 15 p.s.i.g.

Crushed shale particles are passed from crusher 4 through standpipe 20 into surge vessel 6 where the solids are maintained in a fluidized state by a fluidizing gas stream comprised of inert gas, or, more preferably, recycled product gases educed from the raw shale fines retorted in surge vessel 6. The fluidizing gas is introduced via conduit 214 into the lower region of surge vessel 6 at a rate sufficient to maintain the retorted shale particles as a fluidized bed, while the pressure in the upper region of vessel 6 is balanced as hereinafter described so that, at most, only a trace of gas flows through standpipe 20 and crusher 4 either to or from the retort. The balance of pressures in vessel 6, therefore, seals the retort and forestalls escape of retort gases. In the preferred embodiment, the flow of the fluidizing gas stream, as determined by response of flow control valve 26 to flow controller 28, is usually between 4,000 and 8,000, and preferably about 5,000 standard cubic feet per minute per 111.5 tons of retorted shale fed through chute 12 per hour.

To provide heat additional to that available from the hot shale particles entering surge vessel 6, the fluidizing gas stream is itself heated, preferably in two stages. In the first stage, the fluidizing gas stream is preheated in preheater 42, which may be any conventional heat exchanger useful for indirect heat exchange between two gas streams of different temperature. The fluidizing gas is drawn from conduit 106 by blower 104, fed by conduit 40 to preheater 42 and therein heated by indirect heat exchange with a fines-laden gas stream comprising retorted shale fines and educed hydrocarbonaceous vapors. The hot, fines-laden gas stream is recovered from surge vessel 6 and introduced into preheater 42 via conduit 24 at an elevated temperature, usually between 800° and 950° F., and preferably between about 825° and about 875° F., leaving therefrom at a substantially reduced temperature via conduit 50. In the second stage of heating, the fluidizing gas stream received from preheater 42 via conduit 44 is heated in heater 32 to a temperature typically between about 800° and about 100° F., more preferably between about 850° and about 950° F., and most preferably at about 900° F., and sent to surge vessel 6 via conduit 214. Heater 32 is any conventional means for heating a fluid stream, typically a gas-fired furnace fed via conduit 34 by a heater gas stream comprising fuel gas, for example, recycled product fuel gas removed from condensate drum 98 via conduits 156 and 208 and reintroduced (by means not shown) to conduit 34. The rate of the fuel gas stream to heater 32 is controlled by the operation of temperature controller 36 upon flow control valve 38 to regulate the fluidizing gas stream at the desired temperature for retorting raw fines. In surge vessel 6 the heated fluidizing gas stream and hot, crushed particles impart sufficient heat to the raw fines during contact in the fluidized bed to educe hydrocarbonaceous vapors from the fines.

Meanwhile, raw shale fines, which typically range in size from zero (as a fine dust) to $\frac{3}{8}$ inch, and preferably from zero to $\frac{1}{8}$ inch mean diameter, are introduced into surge vessel 6 via conduit 30 using any convenient means of transporting fine particulates to a system being maintained at superatmospheric pressure, such as lock hoppers, screw conveyors, or dilute-phase lift systems. Once introduced into vessel 6, the raw fines are caught up in the turbulent motion of the fluidized bed of crushed particles, increasing to the temperature of pyrolysis by contact with the heated fluidizing gases and particulate heat source. Agglomeration of the fines during pyrolysis is avoided due to the turbulent motion of the fines and particles in the fluidized bed.

In a proportion ranging from about 1 to about 45 percent by weight of the total retorted shale particles, preferably between about 5 and about 10 tons per hour, typically up to about 12.5 tons per hour, and most preferably between about 6 and about 8 tons per hour, fines are introduced into vessel 6 and retorted at essentially the pressure prevailing in the retort, usually between about 5 and about 30 p.s.i.g., and preferably about 15 p.s.i.g., and a temperature typically between about 800° and about 1000° F., and preferably between about 825° and about 875° F. To assure the optimum yield of hydrocarbonaceous vapors, the raw fines are maintained in vessel 6 at the above temperature and pressure for a period of time sufficient to educe said hydrocarbonaceous vapors, typically between about 1.0 and about 5.0 minutes, and preferably between about 1.5 and about 2.5 minutes. Retorting the fines under these conditions typically yields hydrocarbonaceous vapors containing between 80 and 100 percent of the Fischer assay of the raw fines, and, in the preferred embodiment, the yield is at least 90 percent of Fischer assay.

After being retorted, a substantial proportion of the fines gravitates from vessel 6 via standpipe 210 with the retorted shale particles while a minor portion of the fines, usually between 10 and 40, and preferably between 15 and 25 tons per hour, is removed as entrained particulates via conduit 24 in the fines-laden gas stream. This fines-laden gas stream is subjected to heat exchange in heater 42 and subsequently water-scrubbed to eliminate fines from the product fractions as hereinafter described.

One of the functions of the combination of apparatus between retort 2 and cooler 10 is to prevent escape of retort gases while retorted shale is removed and depressurized. The retort may operate at any pressure, but preferably the pressure of the retort is different from that of cooler 10, and more preferably higher than that of the cooler, and most preferably the retort is at a greater superatmospheric pressure than the superatmospheric pressure of the cooler. Pressures in the combination of apparatus between retort 2 and cooler 10 are preferably balanced to prevent any significant flow of gases either to or from retort 2. Pressure in the upper regions of surge vessel 6 is maintained at substantially the pressure prevailing in the upper regions of retort 2 and crusher 4 by adjusting the flow rates of the gas streams entering and leaving vessel 6 via conduits 214 and 24, respectively, while maintaining a desired residence time for fines in vessel 6. Flow controller 28, operating upon flow control valve 26, and flow controller 46, operating upon flow control valve 48, are used to balance flow in these streams to achieve these objectives. The typical rate of flow of the fines-laden gas stream in conduit 50 is maintained substantially equal to the flow of the fluidizing gas stream through conduit 214 plus the vapors educed in vessel 6 from the raw shale fines.

The crushed shale particles and a substantial portion of the retorted fines, accompanied by a small portion of the fluidizing gas stream, are substantially reduced in pressure while being passed from vessel 6 via standpipe 210, pressure-reducing solids flow control valve 16, and standpipe 100 into conduit 52, typically to a pressure between about 2 and about 15 p.s.i.g., and preferably to about 10 p.s.i.g. In the preferred embodiment, solids flow control valve 16 is a slide valve for operation with fluidized solids actuated by level controller 112. The rate of flow of the portion of the fluidizing gas stream which passes from vessel 6 into conduit 52 is preferably substantially equal to the void space in the gravitating shale bed passing through control valve 16 and ranges between about 100 and about 200 standard cubic feet per minute.

In the preferred embodiment, conduit 52 is a dilute phase gas lift through which the crushed shale particles from standpipe 100 are transported by the entraining action of a carrier gas stream directed therein via conduit 114 at a velocity and pressure sufficient to elevate the particles to the entrance of fluidized cooler 10. The carrier gas stream typically comprises any inert gas but is preferably a second portion of the recycle product gas stream fed into conduit 52 by blower 116 through conduit 114 at a rate typically between about 8,000 and about 12,000, and preferably between about 9,000 and about 10,000 standard cubic feet per minute as regulated by flow controller 118 operating upon flow control valve 120.

In cooler 10, the retorted particles are cooled to a temperature typically between about 240° and about 350° F., and more preferably between about 230° and 270° F., and most preferably at about 250° F., while being maintained as a fluidized bed by the fluidizing action of a cooling gas stream directed therein via conduit 124. The rate of flow of the cooling gas stream entering cooler 10 via conduit 124 is sufficient to maintain the particles as a fluidized bed while producing a typical pressure in cooler 10 between about 2 and about 12 p.s.i.g., and preferably between about 9 and about 11 p.s.i.g. Preferably, the cooling gas stream comprises a third portion of the recycle gas stream fed by blower 122 through conduit 124 at a rate controlled by the action of flow controller 204 upon flow control valve 216. Typically, the rate of flow of the cooling gas stream is between about 10,000 and about 20,000, and preferably between about 14,000 and about 15,000 standard cubic feet per minute. Cooling is accomplished by contacting the particles in the fluidized bed within cooler 10 with a controlled flow of water, such as that provided from condensate drum 98 through pump 174 and conduits 176, 126, 128 and 130 into sprays 132 and 134. Preferably, the flow of cooling water is controlled to maintain temperature within vessel 10 as above described by the operation of temperature controller 136, responsive to the temperature of the fines-laden cooler gas stream in conduit 138, upon flow control valve 140 located on conduit 126.

The cooled particles gravitate from cooler 10 through standpipe 202 in an essentially dry condition. Within standpipe 148, additional product hydrocarbonaceous vapors are stripped from said particles by contact with a countercurrently flowing stream of stripping gas directed therein via conduit 152 comprising an inert gas, or, preferably, steam. The flow of the stripping gas stream is regulated by flow control valve 192 in response to flow controller 190 at a rate between about 0.5 and about 2.5, and preferably between about 0.75 and about 1.25 tons per hour. The stripped particles of shale, accompanied by a minor portion of the stripping gas stream approximately equivalent to the void space of the particles, gravitate from standpipe 202 to disposal via conduit 212 at a rate determined by operation of level controller 150 upon solids flow control valve 102. Preferably, flow control valve 102 is a slide valve for gas-solids operation such that the pressure on the particles is reduced by substantially atmospheric during gravitation therethrough. The depressurized and cooled particles of shale and any accompanying gases are sent via conduit 212 to wetting facilities (not shown) as described hereinafter.

A major portion of the stripping gas stream comprising the additional product vapors produced in standpipe 148 exits the standpipe into vessel 10 and mingles with the gases in the fluidized bed. Ultimately, all gases entering cooler 10 are discharged therefrom via conduit 138.

The gas stream recovered from fluidized cooler 10 via conduit 138 comprises a large proportion of the steam generated by water-cooling the hot retorted particles as well as shale fines generated by abrasion of shale particles in cooler 10. Fines are removed from the gas stream recovered from cooler 10 by any means for separating gases from fine particulate solids, such as cyclone separator 142. The relatively particle-free separated gas stream is recovered from cyclone separator 142 via conduit 146 and joins the fines-laden gas stream from conduit 50 to form the fluidizing gas collection stream in conduit 218, which stream comprises steam, entrained fines, and commingled hydrocarbonaceous vapors educed from fines in surge vessel 6 and stripped from particles in standpipe 148 and fluidized cooler 10. Meanwhile, the fines segregated from the separated gas stream in cyclone separator 142, or other means for separating gases from fine particulate solids, are recirculated to the fluidized bed maintained in cooler 10 via conduit 144.

To recover products yielded by retorting the raw fines and stripping the cooled retorted particles, the fluidizing gas collection stream in conduit 218 is passed sequentially through means for removing particulates and means for condensing water and hydrocarbons and separating the condensed water and condensed hydrocarbon gases from uncondensed gases. In the preferred embodiment, the fluidizing gas collection stream is sent via conduit 218 to a system comprising venturi scrubber 54 and scrubber separator 56. Into scrubber 54 a stream of water is directed via conduit 68 at a rate sufficient to form a slurry comprising liquid hydrocarbons condensed by the water, the remaining hydrocarbon vapors, and the retorted fines. Preferably, the rate of water flow into scrubber 54 is controlled by the response of flow control valve 66 to flow controller 64 so as to form a slurry in the scrubber comprising between about 2 and about 25 percent, and preferably between about 4 percent and about 10 percent by volume of particulates. From scrubber 54, the slurry travels via conduit 58 to separator 56 for separation by gravity. Into separator 56 a stream of make-up water is introduced via conduit 194 by operation of flow controller 196 on flow control valve 198 as needed to meet the flow requirements for maintaining the desired volume of water in the slurry.

Separation of the slurry by gravity in scrubber separator 56 provides a heavy water-rich phase containing the retorted fines, which is removed via conduit 62 for recycle as described hereafter; a liquid hydrocarbon-rich phase, which is removed as product via conduit 82, pump 188, and conduits 88 and 90; and a vapor phase stream comprising stripping steam and water vapor generated by cooling the particles, which is removed via conduit 92 for further condensation and separation.

The vapor phase stream removed from scrubber separator 56 via conduit 92 is cooled by any convenient means. In the preferred embodiment, the vapor phase stream from scubber 56 is cooled and partially condensed in air cooler 94, from which it passes via conduit 96 into condensate drum 98 for separation into three phases. Typically, air cooler 94 condenses water vapor to liquid water at a rate of between about 40 and about 70 tons per hour and preferably between about 42.5 and about 52.5 tons per hour.

After gravity separation in condensate drum 98, streams of uncondensed gases, liquid hydrocarbon condensates, and water are individually recovered in conduits 156, 158, and 154, respectively. All of the uncondensed gases and liquid hydrocarbon condensates may be withdrawn from drum 98 as products. However, in the preferred embodiment, only the liquid hydrocarbon condensates are collected in total via conduit 158, pump 182, and conduits 184 and 90, while the uncondensed gases are divided, one portion being recycled via recycle header 110 to provide the gas streams needed in surge vessel 6, gas lift 52, and cooler 10, and the other portion being withdrawn as product via conduits 156 and 208. To monitor removal as product of uncondensed gases in excess of those required for the recycled process streams, pressure controller 206 situated on condensate drum 98 adjusts flow control valve 162 so as to maintain a constant low pressure in drum 98, preferably about 2 p.s.i.g. The recycle portion of the uncondensed gases travels from condensate drum 98 through conduit 156 into recycle header 110, from which three recycle fluidizing gas streams are withdrawn. The first portion of the recycled uncondensed gases becomes the fluidized gas stream for cooler 10, being withdrawn through conduit 164 and forced by blower 122 through conduit 124 into cooler 10. The second portion of the recycled uncondensed gases is withdrawn through conduits 108 and 106 by blower 104, which forces it into surge vessel 6 as the fluidizing gas stream after passage through conduit 40, preheater 42, conduit 44, heater 32, and conduit 214. The third portion of the recycled uncondensed gases is sent to gas lift 52 as the carrier gas stream via conduits 108, 166, blower 116, and conduit 114.

A constant supply of water for recycle to process streams is assured by the addition to drum 98 of make-up water through conduit 168, addition being made as necessary to maintain a constant level of water therein by the operation of level controller 170 upon flow control valve 172 situated on conduit 168. To conserve water, water is withdrawn from drum 98 and recycled via conduit 154 through pump 174 into conduit 176. A first portion of the recycled water from condensate drum 98 passes from conduit 176 into conduit 126, for use as the cooling water stream in cooler 10 described hereinabove. The remaining portion of the recycled water is withdrawn from conduit 176 via conduit 178 at a rate determined by response of flow control valve 66 to flow controller 64. This recycled water is then combined in conduit 68 with a fines-laden stream of water removed from scrubber separator 56 through conduit 62, pump 180, and conduits 70 and 76. Admixture of the fines-laden water stream from separator 56 into the scrubber water stream in conduit 68 is controlled by the operation of flow controller 78 upon flow control valve 80 located on conduit 76 so as to maintain a slurry in scrubber 54 containing the desired volume percentage of particular matter as specified hereinabove. Excess fines-laden water is removed for disposal from separator 56 via conduits 70 and 72 by response of flow control valve 74 situated on conduit 72 to level controller 60 located on separator 56. The excess fines-laden water is preferably sent to a shale wetter (not shown) to be used in wetting down retorted particles of shale as an aid to compaction at the site of disposal.

A stream comprising liquid condensate hydrocarbons is removed from condensate drum 98 via conduit 158 and passed through pump 182 into conduit 184 at a rate determined by level controller 186 operating upon flow control valve 200. The stream of hydrocarbon condensates from separator 56 flows at a rate determined by operation of level controller 84 upon flow control valve 86 through conduits 82 and 88 into conduit 90 where it is joined by the hydrocarbon condensate stream removed from drum 98 via conduit 158, pump 82, and conduit 184. From conduit 90, product hydrocarbon condensates are sent to a facility (not shown) for upgrading.

In a first alternative embodiment of the invention, the crushed retorted particles removed from surge vessel 6 via standpipe 210, solids flow control valve 16, standpipe 100 and conduit 52 are transported to a heat exchange vessel (not shown) in which heat is recovered from the hot particles by conventional methods of indirect heat exchange with a stream of water or other process fluids, which exits from the heat exchange vessel at a temperature substantially higher than that at which it enters. To promote indirect heat exchange with the fluid stream, the crushed particles are typically maintained as a fluidized bed within the heat exchange vessel. After heat exchange, the crushed retorted particles are removed from the heat exchange vessel at a substantially reduced temperature and subsequently passed to cooler 10 for additional cooling in the manner described hereinabove.

In a second alternative embodiment, retorted shale particles are not sent to cooler 10 for cooling, but once used to provide heat for retorting raw shale fines, are recovered via standpipe 210, solids flow control valve 16, and standpipe 100, and sent entrained in a carrier gas stream via gas lift 52 to a conventional fluidized bed combustor wherein residual carbonaceous and/or hydrocarbonaceous materials on the fines and particulates are burned for secondary energy recovery. The carrier gas stream used to transport shale particles to the combustor is comprised of inert gas or, preferably, air. Meanwhile, as the particles gravitate from vessel 6, a stream of countercurrently flowing stripping gas comprising inert gas, preferably steam, is introduced into a standpipe 210 to strip hydrocarbonaceous vapors from the retorted shale. For recovery of product stripped from the shale, the stream of stripping gas is mingled with the fines-laden gas stream in vessel 6 and removed therefrom via conduit 24 to be sent through the scrubber-separator system as described above.

However, the large amounts of steam generated by cooling the hot retorted particles in the preferred embodiment is absent from the collected fluidizing gas stream in this embodiment since cooler 10 is not used. Consequently, the amount of steam in the gas stream entering cooler 94 is substantially reduced, thereby correspondingly reducing the cooling capacity required of cooler 94. The recycled water stream removed from condensate drum 98 is similarly reduced and flows entirely through flow control valve 66 into conduit 68 and scrubber 54, no division of a recycle stream to the fluidized shale cooler being needed.

A single-stage fluidized combustor, such as that disclosed in a U.S. patent application Ser. No. 451,597 filed Dec. 20, 1982, or a staged-bed fluidized combustor, such as that disclosed in U.S. patent application Ser. No. 495,505 filed May 17, 1983, may be used to recover residual energy from retorted shale by burning coke contained in the crushed particles. Combustion of retorted shale particles with subsequent heat recovery from combustion flue gases substantially increases the total energy recovered from the raw shale.

The process for retorting raw hydrocarbon-containing fines as above described provides significant advantages. When used in a process utilizing a conventional upflow oil shale retort, an increase is achieved of as much as 6 percent in net product yielded from the shale after the energy requirements for retorting and recovering product as herein described have been met, a figure which represents a considerable increase in energy recovery from the retorting process. An additional benefit of retorting raw fines using the process of this invention is that agglomeration of the fines during retorting is substantially reduced by the turbulent motion of the fines and particles in the fluidized bed. Yet another advantage of the process of this invention is that the fluidized zone in which the fines are retorted serves the additional function of providing a seal to the retort, which prevents escape of product gases from the retort while crushed, retorted particles are depressurized and removed from the retorting system without plugging.

Although the invention has been described in conjunction with a preferred embodiment thereof, it is evident that many alternatives, modifications, and variations will be apparent to those skilled in the art in light of the foregoing description. For example, a variety of hydrocarbon-containing particulates may be used in the process of the invention, including coal and lignite. Accordingly, it is intended to embrace this and all such alternatives, modifications, and variations that fall within the spirit and scope of the appended claims.

I claim:

1. A retorting process comprising:

retorting hydrocarbon-containing particles of a size not readily fluidizable by contact with heated gases in a retorting zone;

crushing hot, uncombusted particles removed from said retorting zone in a crushing zone to a size more readily fluidizable;

maintaining hot, crushed, uncombusted particles removed from said crushing zone in a fluidization zone as a fluidized bed under substantially noncombustive conditions;

retorting raw hydrocarbon-containing fines introduced into said fluidization zone so as to educe hydrocarbon vapors from said fines;

recovering the educed hydrocarbon vapors; and recovering retorted particulates from said fluidization zone.

2. The process defined in claim 1 wherein the retorting zone, the crushing zone, and the fluidization zone are in fluid communication.

3. The process defined in claim 2 wherein said retorting zone is operated at superatmospheric pressure and flow of the retort gases from the retorting zone is prevented by the gas pressure maintained in said fluidization zone.

4. The process defined in claim 2 wherein said retorting zone is maintained at superatmospheric pressure and gas pressure in said crushing zone is essentially equal thereto so that essentially no gases flow from said retorting zone into said crushing zone or into said retorting zone from said crushing zone.

5. The process as defined in claim 1 wherein the percentage of raw fines introduced into said fluidization zone is between about 1 and 45 percent by weight of the total retorted shale particles.

6. The process as defined in claim 1 wherein the hot, uncombusted particles removed from said retorting zone are crushed in said crushing zone to less than $\frac{3}{8}$-inch mean diameter in size.

7. The process as defined in claim 1 wherein a fluidizing gas is introduced into said fluidization zone, said fluidizing gas having been heated at least in part by heat exchange with the educed hydrocarbon vapors.

8. The process as defined in claim 1 wherein said fines range in size from dust to $\frac{3}{8}$-inch mean diameter.

9. The process as defined in claim 1 wherein the yield of educed vapors from retorting the fines in said fluidization zone is between 80 and 100 percent of Fischer assay.

10. A process for retorting oil shale, which process comprises:

retorting raw shale particles of a size not readily fluidizable in an upflow retorting zone by contact with heated gases;

crushing heated, coke-containing shale particles removed from said retorting zone in a crushing zone to a size more readily fluidizable;

maintaining hot, crushed, coke-containing shale particles removed from said crushing zone in a fluidization zone as a fluidized bed under substantially non-combustive conditions;

retorting raw hydrocarbon-containing shale fines introduced into said fluidization zone so as to educe hydrocarbon vapors from said fines;

recovering the educed hydrocarbon vapors; and recovering retorted particulates from said fluidization zone.

11. The process defined in claim 10 wherein the retorting zone, the crushing zone, and the fluidization zone are in fluid communication.

12. The process defined in claim 11 wherein said retorting zone is operated at superatmospheric pressure and flow of the retort gases from the retorting zone is prevented by the gas pressure maintained in said fluidization zone.

13. The process defined in claim 11 wherein said retorting zone is operated at superatmospheric pressure and gas pressure in said crushing zone is equal thereto so that essentially no gases flow from said retorting zone into said crushing zone or into said retorting zone from said crushing zone.

14. The process as defined in claim 10 wherein the hot, coke-containing particles removed from said retorting zone are crushed in said crushing zone to less than $\frac{1}{4}$-inch mean diameter in size.

15. The process as defined in claim 10 wherein the fines range in size from dust to $\frac{1}{8}$-inch mean diameter.

16. The process as defined in claim 10 wherein the yield of educed vapors from retorting the fines in said fluidization zone is at least 80 percent of the Fischer Assay.

17. The process as defined in claim 10 wherein the particulates are recovered from the fluidization zone through a pressure reducing valve.

18. A process for retorting raw hydrocarbon-containing fines using heat from retorted particles, which process comprises:

retorting raw shale particles of a size not readily fluidizable in an upflow retorting zone by contact with heated retort gases;

crushing hot particles removed from said retorting zone in a crushing zone to a size more readily fluidizable;

maintaining crushed, coke-containing particles removed from said crushing zone in a heated condition as a fluidized bed in a fluidization zone under substantially non-combustive conditions at a temperature sufficient to educe hydrocarbon vapors from unretorted hydrocarbon-containing fines;

retorting hydrocarbon-containing fines introduced into said fluidization zone as to educe hydrocarbon vapors from said fines;

recovering the educed hydrocarbon vapors; and recovering said crushed particles and a substantial portion of said fines from said fluidization zone.

19. A process as defined in claim 18, which process further comprises:

removing particles from said educed hydrocarbon vapors in a scrubbing zone;

partially condensing said hydrocarbon vapors removed from said scrubbing zone in a cooling zone;

separating partially condensed vapors removed from said cooling zone in a separation zone;

recovering a product gas stream comprising uncondensable hydrocarbon gases, a product liquid stream comprising hydrocarbon liquids, and a waste water stream comprising water from said separation zone;

transporting crushed particles and fines from said fluidization zone to a cooling zone using a carrier gas stream;

cooling said crushed particles and fines in a cooling zone, said particles and fines being maintained as a fluidized bed therein;

stripping hydrocarbon vapors from cooled crushed particles and fines removed from said cooling zone in a stripping zone;

recovering said stripped vapors from said stripping zone;

admixing said stripped vapors into said educed vapors from said fluidization zone; and removing stripped particles and fines from said stripping zone.

20. A process as defined in claim 19 further comprising:

transporting said crushed particles and fines recovered from said fluidization zone to a cooling zone;

cooling said crushed particles and fines in a cooling zone wherein said particles and fines are maintained in a fluidized bed; and recovering hydrocarbon vapors from said cooling zone.

21. A process as defined in claim 20 wherein said transporting is carried out by means of entrainment of the crushed particles and fines in a flowing carrier gas stream.

22. A process for retorting raw shale fines using heat from retorted shale particles, which process comprises:
retorting raw shale particles of a size not readily fluidizable in an upflow retorting zone by contact with heated retort gases;
removing hot, coke-containing, retorted shale particles from the retorting zone without substantial loss of heat or substantial loss of retort gases and passing said particles into a crushing zone;
crushing said hot, coke-containing retorted shale particles recovered from said retorting zone in the crushing zone to a size more readily fluidizable;
maintaining hot, crushed, retorted coke-containing, shale particles from said crushing zone as a fluidized bed in a fluidization zone under substantially non-combustive conditions at a temperature sufficient to educe hydrocarbon vapors from unretorted shale fines;
retorting shale fines introduced into said fluidization zone so as to educe hydrocarbon vapors from said fines;
recovering the educed hydrocarbon vapors; and
recovering the crushed shale particles and a substantial portion of said fines from said fluidization zone.

23. A process as defined in claim 22 further comprising:
transporting crushed particles and retorted fines from said fluidization zone to a cooling zone;
cooling said crushed shale particles and retorted fines in said cooling zone while said particles and fines are maintained in a fluidized condition; and
recovering hydrocarbon vapors from said cooling zone.

24. A process as defined in claim 23 wherein said transporting is carried out by means of entrainment of the crushed particles and fines in a flowing carrier gas stream.

25. A process as defined in claim 22 wherein said crushing zone is maintained at substantially retorting pressure and said fluidization zone is maintained at substantially retorting pressure.

26. A process as defined in claim 22, which process further comprises:
removing particles from said educed hydrocarbon vapors in a scrubbing zone;
partially condensing said hydrocarbon vapors removed from said scrubbing zone in a cooling zone;
separating partially condensed vapors removed from said cooling zone in a separation zone;
recovering a product gas stream comprising uncondensable hydrocarbon gases, a product liquid stream comprising hydrocarbon liquids, and a waste water stream comprising water from said separation zone;
transporting crushed particles and fines from said fluidization zone to a cooling zone using a carrier gas stream;
cooling said crushed particles and fines in a cooling zone, said particles and fines being maintained as a fluidized bed therein;
stripping hydrocarbon vapors from cooled crushed particles and fines removed from said cooling zone in a stripping zone;
recovering said stripped vapors from said stripping zone;
admixing said stripped vapors into said educed vapors from said fluidization zone; and
removing stripped particles and fines from said stripping zone.

27. A process as defined in claim 26 wherein said process further comprises:
contacting said particles in said cooling zone with water so as to reduce the temperature in said cooling zone to at least about 350° F. while said cooling zone is maintained at superatmospheric pressure, said water being a recycled portion of said waste water stream; and
admixing said vapor stream comprising water vapor into the vapor stream recovered from said fluidization zone.

28. A process for retorting raw shale fines using heat from retorted shale particles, which process comprises:
retorting raw shale particles of a size not readily fluidizable in an upflow retorting zone by contact with heated retort gases;
removing hot, coke-containing retorted shale particles from the retorting zone without substantial loss of heat or substantial loss of retort gases and passing said particles into a crushing zone;
crushing said hot shale particles removed from said retorting zone in the crushing zone to a size more readily fluidizable;
maintaining hot, crushed, coke-containing particles recovered from said crushing zone as a fluidized bed in a fluidization zone under substantially non-combustive conditions at a temperature sufficient to educe hydrocarbon vapors from unretorted shale fines;
injecting a non-oxidizing fluidizing gas into said fluidization zone, the heat in said fluidizing gas being sufficient to maintain said fluidization zone at said temperature;
retorting shale fines introduced into said fluidization zone so as to educe hydrocarbon vapors from said fines;
recovering the educed hydrocarbon vapors;
removing particulates from said educed vapors in a scrubbing zone;
partially condensing the educed vapors removed from said scrubbing zone in a cooling zone;
separating partially condensed vapors removed from said cooling zone in a separation zone;
recovering separately from said separation zone a product gas stream comprising hydrocarbon gases, a product liquid stream comprising hydrocarbon liquids and a waste water stream comprising water; and
recovering said crushed shale particles and a substantial portion of said fines from said fluidization zone.

29. A process as defined in claim 26 wherein pressure in the upper region of said fluidization zone is maintained substantially equal to the pressure in the crushing zone, the pressure in the crushing zone is maintained substantially equal to the pressure in the retorting zone, and the gas pressure on the particles and fines recovered from said fluidization zone is reduced to about atmospheric while being recovered from said fluidization zone through a solids flow control valve.

30. A process as defined in claim 28 wherein said retorting zone is operated at a pressure of about 20 p.s.i.g. or more and at a temperature in excess of about 900° F.

31. A process as defined in claim 28 wherein said crushed retorted particles are less than ½ inch in mean diameter, said raw fines range in size from a fine dust to $\frac{3}{8}$ inch mean diameter, the temperature of said fines-laden gas stream recovered from said fluidization zone is from about 800° F. to about 900° F., said fluidizing gas stream is heated to a temperature between about 850° and about 950° F. in said heating zone, the amount of fines added to said fluidization zone is from about 1 to about 45 weight percent of the crushed particles held therein as a fluidized bed, and the energy recovered from the retorting process is increased by the additional product yielded by retorting said fines.

32. A process as defined in claim 28 wherein the hydrocarbon products recovered from said product gas stream and liquid hydrocarbon product stream are at least about 80 percent of the Fischer assay of the raw fines.

33. A process as defined in claim 30 further comprising:

transporting said crushed shale particles and fines recovered from said fluidization zone to a cooling zone;

cooling said particles and fines in said cooling zone while said particles and fines are maintained in a fluidized bed; and recovering hydrocarbon vapors from said cooling zone and combining them with said educed hydrocarbon vapors recovered from said fluidization zone prior to removing particulates therefrom in said scrubbing zone.

34. A process as defined in claim 33 wherein said transporting is carried out by entrainment in a flowing carrier gas stream.

35. A process as defined in claim 34 wherein hydrocarbon products recovered from said product gas stream and said liquid hydrocarbon product stream are at least about 90 percent of the Fischer assay of the raw fines.

36. A process as defined in claim 35 wherein said scrubbing zone is a venturi scrubber, water from said waste water stream being recycled to said venturi scrubber so as to form a slurry comprising between about 2 and about 12 percent particulate solids by volume and said slurry being recovered from said venturi scrubber and sent to said separation zone for separation into three phases.

37. A process for retorting raw shale fines using heat from retorted shale particles, which process comprises:

retorting raw shale particles of a size not readily fluidizable in an upflow retorting zone by contact with heated retorting gases;

removing hot, coke-containing retorted shale particles from the retorting zone, said retorting zone operating at a temperature in excess of about 900° F. and at a superatmospheric pressure without substantial loss of heat or substantial loss of retort gases and passing said particles into a crushing zone;

crushing said hot, coke-containing shale particles recovered from said retorting zone in the crushing zone maintained at substantially retorting pressure to a size more readily fluidizable;

holding hot, crushed, coke-containing shale particles from said crushing zone in a fluidization zone maintained as a fluidized bed by the action of a preheated fluidizing gas stream comprising inert gas directed therein at a rate sufficient to maintain said particles as a fluidized bed;

preheating said fluidizing gas stream in a heating zone so as to assist in maintaining the temperature in said fluidization zone at about 800° F.;

educing hydrocarbon vapors from raw shale fines in said fluidization zone, which hydrocarbon vapors comprise about 90 percent of the Fischer assay of the carbon compounds contained in said fines;

recovering the educed hydrocarbon vapors from said fluidization zone;

discharging the crushed particles and a substantial proportion of said fines from said fluidization zone while restricting the rate at which gases are removed therefrom together with said particles;

transporting particles and fines discharged from said fluidization zone to a cooling zone by entraining said particles and fines in a carrier gas stream comprising inert gas;

cooling said particles and fines by contact with water in a cooling zone while said particles and fines are maintained as a fluidized bed by the action of a cooling gas stream comprising inert gas directed therein at a rate sufficient to fluidize the largest of said particles, temperature in said cooling zone being maintained between about 240° and about 350° F.;

recovering vapors comprising steam from said cooling zone;

stripping hydrocarbon vapors from cooled shale particles and fines removed from said cooling zone in a stripping zone by countercurrently contacting said particles and fines with a stripping gas stream comprising inert gas;

recovering stripped hydrocarbon vapors from said stripping zone;

recovering hydrocarbon products and waste water from said educed vapors, said stripped vapors, and said vapors recovered from said cooling zone in a scrubber-separator zone by passing said vapors sequentially through four zones wherein:

in a scrubbing zone, incorporating said vapors into a water slurry comprising sufficient water so that the particulate matter contained within said slurry comprises between about 2 and about 12 volume percent;

in a first separation zone, separating the water slurry recovered from said scrubbing zone into a vapor phase stream comprising water vapor and hydrocarbon vapors, a liquid hydrocarbon phase comprising liquid hydrocarbons, and a water phase comprising water and said particulate matter recovered from said slurry;

in a cooling zone, partially condensing the vapor phase stream recovered from said first separation zone so as to condense a substantial proportion of the water vapor contained therein;

in a second separation zone, separating the partially condensed vapor stream recovered from said cooling zone into a product vapor phase comprising hydrocarbon vapors, a liquid hydrocarbon phase comprising liquid hydrocarbon product, and a waste water phase; and withdrawing separately from said second separation zone a product vapor stream and a product liquid hydrocarbon stream.

38. A process as defined in claim 37 wherein portions of said product vapor stream recovered from said separation zone are recycled to provide the carrier gas stream and the fluidizing streams to the fluidization zone and the fluidized cooling zone, while portions of the waste water stream recovered from said separation zone are recycled to the fluidized cooling zone and to the scrubbing zone, sufficient make-up water being added to the waste water stream to maintain said temperature in said fluidized cooling zone and said volume percent of particulates in said slurry.

39. A process as defined in claim 38 wherein in said heating zone said fluidizing gas is heated by exchanging heat with vapors removed from said fluidization zone.

40. A process as defined in claim 39 wherein in said heating zone said fluidizing gas is heated in a gas-fired furnace, said furnace being fueled by a recycled portion of the product vapor stream recovered from the second separation zone.

41. A process as defined in claim 40 wherein said crushed retorted shale particles are less than ½ inch in mean diameter, said raw shale fines range in size from a fine dust to ⅜ inch mean diameter, the temperature of said fines-laden gas stream recovered from said fluidization zone is from about 800° F. to about 900° F., said fluidizing gas stream is heated to a temperature between about 850° and about 950° F. in said heating zone, the amount of fines added to said fluidization zone is from about 1 to about 45 weight percent of the crushed particles held therein as a fluidized bed, and the energy recovered from the retorting process is increased by the additional product yielded by retorting said raw shale fines.

42. A process as defined in claim 40 wherein said fines are retorted in said zone of fluidization at a temperature of about 850° F. for a residence time of about 2 minutes and the hydrocarbon products recovered from said product vapor stream and said product liquid hydrocarbon stream are at least about 80 percent of the Fischer assay of the raw shale fines.

43. A process as defined in claim 42 wherein the hydrocarbon products recovered from said product vapor stream and said product liquid hydrocarbon stream are at least about 90 percent of the Fischer assay of the raw shale fines.

44. A process as defined in claim 39 wherein pressure in the upper region of said fluidization zone is maintained at substantially retorting pressure, the gas pressure on said crushed particles and fines being reduced to about 12 p.s.i.g. during recovery from said zone of fluidization through a first pressure-reducing means, and said cooling zone is maintained at a pressure between about 9 and about 11 p.s.i.g. and a temperature between about 230° and about 270° F., the gas pressure on the stripped particles recovered from said zone being reduced to about atmospheric during recovery from said stripping zone through a second pressure-reducing means.

45. A retorting process comprising:

retorting hydrocarbon-containing particles of a size greater than ½ inch mean diameter by contact with heated gases in a retorting zone;

crushing hot, uncombusted particles removed from said retorting zone to a size less than ½ inch means diameter;

maintaining hot, crushed, uncombusted particles removed from said crushing zone in a fluidization zone as a fluidized bed under substantially non-combustive conditions;

retorting raw hydrocarbon-containing fines introduced into said fluidization zone so as to educe hydrocarbon vapors from said fines;

recovering the educed hydrocarbon vapors; and recovering retorted particles from said fluidization zone.

46. A process for retorting oil shale, which process comprises:

retorting raw shale particles of a size greater than ½ inch mean diameter in an upflow retorting zone by contact with heated gases;

crushing heated, coke-containing shale particles removed from said retorting zone in a crushing zone to a size less than ½ inch means diameter;

maintaining hot, crushed, coke-containing shale particles removed from said crushing zone in a fluidization zone as a fluidized bed under substantially non-combustive conditions;

retorting raw hydrocarbon-containing shale fines introduced into said fluidization zone so as to educe hydrocarbon vapors from said fines;

recovering the educed hydrocarbon vapors; and recovering retorted particulates from said fluidization zone.

47. A process for retorting raw hydrocarbon-containing fines using heat from retorted particles, which process comprises:

retorting raw shale particles of a size greater than ½ inch mean diameter in an upflow retorting zone by contact with heated retort gases;

crushing hot particles removed from said retorting zone in a crushing zone to a size less than ½ inch mean diameter;

maintaining crushed, coke-containing particles removed from said crushing zone in a heated condition as a fluidized bed in a fluidization zone under substantially non-combustive conditions at a temperature sufficient to educe hydrocarbon vapors from unretorted hydrocarbon-containing fines;

retorting raw hydrocarbon-containing fines introduced into said fluidization zone so as to educe hydrocarbon vapors from said fines;

recovering the educed hydrocarbon vapors; and recovering said crushed particles and a substantial portion of said fines from said fluidization zone.

48. A process for retorting raw shale fines using heat from retorted shale particles, which process comprises:

retorting raw shale particles of a size greater than ½ inch mean diameter in an upflow retorting zone by contact with heated retort gases;

removing hot, coke-containing, retorted shale particles from the retorting zone without substantial loss of heat or substantial loss of retort gases and passing said particles into a crushing zone;

crushing said hot, coke-containing retorted shale particles recovered from said retorting zone in the crushing zone to a size less than ½ inch mean diameter;

maintaining hot, crushed, retorted coke-containing, shale particles from said crushing zone as a fluidized bed in a fluidization zone under substantially non-combustive conditions at a temperature sufficient to educe hydrocarbon vapors from unretorted shale fines;

retorting raw shale fines introduced into said fluidization zone so as to educe hydrocarbon vapors from said fines;

recovering the educed hydrocarbon vapors; and recovering the crushed shale particles and a substantial portion of said fines from said fluidization zone.

49. A process for retorting raw shale fines using heat from retorted shale particles, which process comprises:

retorting raw shale particles of a size greater than ½ inch mean diameter in an upflow retorting zone by contact with heated retort gases;

removing hot, coke-containing retorted shale particles from the retorting zone without substantial loss of heat or substantial loss of retort gases and passing said particles into a crushing zone;

crushing said hot shale particles removed from said retorting zone in the crushing zone to a size less than one ½ inch mean diameter;

maintaining hot, crushed, coke-containing particles recovered from said crushing zone as a fluidized bed in a fluidization zone under substantially non-combustive conditions at a temperature sufficient to educe hydrocarbon vapors from unretorted shale fines;

injecting a non-oxidizing fluidizing gas into said fluidization zone, the heat in said fluidizing gas being sufficient to maintain said fluidization zone at said temperature;

retorting raw shale fines introduced into said fluidization zone so as to educe hydrocarbon vapors from said fines;

recovering the educed hydrocarbon vapors;

removing particulates from said educed vapors in a scrubbing zone;

partially condensing the educed vapors removed from said scrubbing zone in a cooling zone;

separating partially condensed vapors removed from said cooling zone in a separation zone;

recovering separately from said separation zone a product gas stream comprising hydrocarbon gases, a product liquid stream comprising hydrocarbon liquids and a waste water stream comprising water; and recovering said crushed shale particles and a substantial portion of said fines from said fluidization zone.

50. A process as defined in claim 49 further comprising:

transporting said crushed shale particles and fines recovered from said fluidization zone to a cooling zone;

cooling said particles and fines in said cooling zone while said particles and fines are maintained in a fluidized bed; and recovering hydrocarbon vapors from said cooling zone and combining them with said educed hydrocarbon vapors recovered from said fluidization zone prior to removing particulates therefrom in said scrubbing zone.

51. A process as defined in claim 50 wherein said transporting is carried out by entrainment in a flowing carrier gas stream.

52. A process as defined in claim 49 wherein hydrocarbon products recovered from said product gas stream and said product liquid stream are at least about 90 percent of the Fischer assay of the raw fines.

53. A process as defined in claim 50 wherein said scrubbing zone is a venturi scrubber, water from said waste water stream being recycled to said venturi scrubber so as to form a slurry comprising between about 2 and about 12 percent particulate solids by volume and said slurry being recovered from said venturi scrubber and sent to said separation zone for separation into three phases.

54. A process as defined in claim 49 wherein said retorting zone is operated at a pressure of about 20 p.s.i.g. or more and at a temperature in excess of about 900° F.

55. A process as defined in claim 49 wherein said raw fines range in size from a fine dust to ⅜ inch mean diameter, the temperature of said fines-laden gas stream recovered from said fluidization zone is from about 800° F. to about 900° F., said fluidizing gas stream is heated to a temperature between about 850° and about 950° F. in said heating zone, the amount of fines added to said fluidization zone is from about 1 to about 45 weight percent of the crushed particles held therein as a fluidized bed, and the energy recovered from the retorting process is increased by the additional product yielded by retorting said fines.

56. A process as defined in claim 49 wherein the hydrocarbon products recovered from said product gas stream and product liquid stream are at least about 80 percent of the Fischer assay of the raw fines.

57. The process defined in claims 45, 46, 47, 48 or 49 wherein the retorting zone, the crushing zone and the fluidization zone are in fluid communication and the retorting zone is maintained at superatmospheric pressure while gas pressure in said crushing zone is essentially equal thereto so that essentially no gases flow from said retorting zone into said crushing zone or into said retorting zone from said crushing zone.

58. The process defined in claim 45, 46, 47, 48 or 49 wherein the particles are crushed in said crushing zone to a size less than ¼ inch mean diameter.

59. The process defined in claims 45, 46, 47, 48 or 49 wherein the particles are crushed in said crushing zone to a size less than ⅜ inch mean diameter.

60. The process defined in claim 50 wherein the particles are crushed in said crushing zone to a size less than ¼ inch mean diameter.

61. A process as defined in claim 45, 46, 47, 48, 49 or 60 wherein said retorting zone is operated at a pressure of about 20 p.s.i.g. or more and at a temperature in excess of about 900° F.

62. A process as defined in claim 45, 46, 47, 48, 49 or 60 wherein said raw fines range in size from a fine dust to ⅜ inch mean diameter, the temperature of said fines-laden gas stream recovered from said fluidization zone is from about 800° F. to about 900° F., said fluidizing gas stream is heated to a temperature between about 850° and about 950° F., in said heating zone, the amount of fines added to said fluidization zone is from about 1 to about 45 weight percent of the crushed particles held therein as a fluidized bed, and the energy recovered from the retorting process is increased by the additional product yielded by retorting said fines.

63. A process as defined in claim 45, 46, 47, 48, 49 or 60 wherein the hydrocarbon products recovered from said product gas stream and liquid hydrocarbon product stream are at least about 80 percent of the Fischer assay of the raw fines.

* * * * *